US007467845B2

(12) United States Patent
Takatsuka et al.

(10) Patent No.: US 7,467,845 B2
(45) Date of Patent: Dec. 23, 2008

(54) IMAGE FORMING APPARATUS

(75) Inventors: Tsutomu Takatsuka, Kaiseimachi (JP); Yasuhiko Kachi, Kaiseimachi (JP)

(73) Assignee: Fujifilm Corporation, Tokyo (JP)

( * ) Notice: Subject to any disclaimer, the term of this patent is extended or adjusted under 35 U.S.C. 154(b) by 300 days.

(21) Appl. No.: 10/946,485

(22) Filed: Sep. 22, 2004

(65) Prior Publication Data

US 2005/0093919 A1 May 5, 2005

(30) Foreign Application Priority Data

Sep. 22, 2003 (JP) ..... 2003-330322

(51) Int. Cl.
*B41J 2/165* (2006.01)
*B41J 2/17* (2006.01)
*B41J 2/175* (2006.01)

(52) U.S. Cl. ..... 347/30; 347/35; 347/36; 347/84; 347/85

(58) Field of Classification Search ..... 347/29, 347/30, 31, 33, 35, 36, 84, 85, 89, 90, 93, 347/101, 104
See application file for complete search history.

(56) References Cited

U.S. PATENT DOCUMENTS

| | | | | |
|---|---|---|---|---|
| 5,510,822 | A * | 4/1996 | Vincent et al. | 347/102 |
| 5,712,672 | A * | 1/1998 | Gooray et al. | 347/102 |
| 5,717,446 | A * | 2/1998 | Teumer et al. | 347/35 |
| 6,038,776 | A * | 3/2000 | Yamada et al. | 33/18.1 |
| 6,254,092 | B1 * | 7/2001 | Yraceburu et al. | 271/276 |
| 6,382,767 | B1 * | 5/2002 | Greive | 347/30 |
| 6,860,582 | B2 * | 3/2005 | Vega et al. | 347/35 |
| 7,114,804 | B2 * | 10/2006 | Nunokawa | 347/104 |
| 7,144,106 | B2 * | 12/2006 | Ishii et al. | 347/104 |
| 2002/0041303 | A1 | 4/2002 | Yoshinaga | |
| 2002/0060713 | A1 * | 5/2002 | Katakura et al. | 347/30 |
| 2004/0125154 | A1 * | 7/2004 | Cheney et al. | 346/35 |
| 2004/0169712 | A1 * | 9/2004 | Tsuji | 347/104 |
| 2004/0189735 | A1 * | 9/2004 | Ishii et al. | 347/22 |
| 2005/0122372 | A1 * | 6/2005 | Shimizu | 347/22 |

FOREIGN PATENT DOCUMENTS

| | | | | |
|---|---|---|---|---|
| CA | 2291925 | A1 | | 12/1998 |
| JP | 4-53752 | A | | 2/1992 |
| JP | 05069606 | A | * | 3/1993 |
| JP | 2000-168108 | A | | 6/2000 |
| JP | 2001105583 | A | * | 4/2001 |
| JP | 2001-212990 | A | | 8/2001 |
| JP | 2001-347651 | A | | 12/2001 |
| JP | 2002144650 | A | * | 5/2002 |
| JP | 2002-187261 | A | | 7/2002 |
| JP | 2002-356026 | A | | 12/2002 |
| JP | 2003034057 | A | * | 2/2003 |
| JP | 2003039758 | A | * | 2/2003 |

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The image forming apparatus comprises: a discharging head which has a nozzle surface on which nozzles for discharging liquid droplets are formed; a medium supporting device which supports a recording medium, the medium supporting device being disposed in a position opposing the nozzle surface of the discharging head, the medium supporting device including a liquid collecting device having inclined surfaces along which liquid entering from a side of the discharging head is slidable downwards, and openings formed at bases of the inclined surfaces and connecting to a rear surface of the medium supporting device; and a suctioning device which suctions the liquid through the openings in the liquid collecting device.

15 Claims, 12 Drawing Sheets

IMAGE FORMING APPARATUS

This Non-provisional application claims priority under 35 U.S.C. § 119(a) on patent application Ser. No. 2003-330322 filed in Japan on Sep. 22, 2003, the entire contents of which are hereby incorporated by reference.

BACKGROUND OF THE INVENTION

1. Field of the Invention

The present invention relates to an image forming apparatus, and more particularly, to a liquid recovery system suitable for an inkjet recording apparatus and other image forming apparatuses, having a discharging head which discharges droplets from nozzles onto a recording medium.

2. Description of the Related Art

Japanese Patent Application Publication No. 2002-356026 discloses an inkjet printer having a line head wherein a plurality of nozzles are arranged in a direction orthogonal to the conveyance direction of paper, wherein a paper conveyance region and a maintenance region are provided on an endless belt which encompasses a platen member, the maintenance region of the endless belt is made to oppose the nozzle surface of the line head during a maintenance operation, and preliminary discharge (an operation for forcibly discharging ink in order to prevent blockage of the nozzles) is performed onto the maintenance region of the belt. The endless belt according to this disclosure is able to hold the ink discharged on to the maintenance region temporarily, and after preliminary discharge, the endless belt is caused to travel, thereby moving the maintenance region to a position opposing a maintenance unit, and the ink adhering to the maintenance region is removed by suction by means of a suction pump.

Furthermore, Japanese Patent Application Publication No. 2000-168108 discloses an inkjet printing apparatus wherein a support medium for supporting a recording sheet during a printing process is made from a porous material (such as a porous film, a porous sheet or a porous band). According to this apparatus, the support medium is connected to a vacuum source, and surplus ink accumulated on the support medium is absorbed by the porous material and is suctioned and removed through the support medium.

However, in the structures disclosed in Japanese Patent Application Publication No. 2002-356026 and Japanese Patent Application Publication No. 2000-168108, since, in both cases, the ink is absorbed and retained in the supporting member which directly supports the recording medium, then the ink dries inside the supporting member, causing blockages and deterioration of absorbing properties, and also causing soiling of the rear face of the recording medium. Furthermore, in the structure according to the prior art, a large-scale suctioning device is required in order to suction and discharge ink from the supporting member in which the ink is retained.

SUMMARY OF THE INVENTION

The present invention has been contrived in view of such circumstances, and an object thereof is to provide an image forming apparatus whereby liquid removal characteristics are improved, and furthermore, soiling of the rear surface of the recording medium can be prevented.

In order to attain the above-described object, the present invention is directed to an image forming apparatus, comprising: a discharging head which has a nozzle surface on which nozzles for discharging liquid droplets are formed; a medium supporting device which supports a recording medium, the medium supporting device being disposed in a position opposing the nozzle surface of the discharging head, the medium supporting device including a liquid collecting device having inclined surfaces along which liquid entering from a side of the discharging head is slidable downwards, and openings formed at bases of the inclined surfaces and connecting to a rear surface of the medium supporting device; and a suctioning device which suctions the liquid through the openings in the liquid collecting device.

According to the present invention, a liquid collecting device constituted by inclined surfaces along which liquid can slide and openings for allowing liquid collected by the inclined surfaces to pass to the rear surface of the medium supporting device (the opposite side to the medium supporting surface), is provided in the medium supporting device disposed in a position opposing the nozzle surface (liquid discharging surface) of the discharging head, and the liquid dropping onto the medium supporting surface is suctioned via the openings in the liquid collecting device. Thus, it is possible to recover droplets readily from the medium supporting device, and hence liquid removal characteristics can be improved.

Preferably, the liquid collecting device is constituted by through holes having relatively broad openings on the side of the discharging head, and relatively narrow openings on the side of the suctioning device. According to this, by forming inclined surfaces on the side walls of the through holes leading from the openings on the discharging head side to the openings on the suctioning device side (rear side), the liquid droplets slide downwards readily over the inclined surfaces, and hence the droplets that have entered into the openings on the discharging head side can be recovered in a highly efficient manner.

Preferably, perimeters of the through holes on the side of the discharging head in the liquid collecting device have a ridge line shape whereby the recording medium is supported by means of line contact. According to this, the liquid does not adhere to the rear surface of the recording medium, and hence soiling of the rear surface is prevented.

Preferably, the liquid collecting device has the ridge line shape that is not orthogonal to a conveyance direction of the recording medium. By supporting the recording medium by means of ridge lines which are not orthogonal to the conveyance direction of the recording medium, it is possible to stably hold the recording medium, hence there are no problems such as catching of the recording medium on the ridge lines, and conveyance characteristics can be improved.

Preferably, the liquid collecting device has projections which support the recording medium by means of point contact, and side faces of the projections constitute the inclined surfaces. According to this, a plurality of projections having a pointed shape for supporting the recording medium on points are arranged on the medium supporting surface of the medium supporting device, the recording medium can be stably held, and at the same time, soiling of the rear surface of the recording medium is prevented, liquid is collected by the inclined surfaces of the side faces of the projections, and the liquid can be recovered from the openings formed at the bases of the inclined surfaces.

Preferably, the liquid collecting device has liquid repelling properties. According to this, it is possible to recover liquid in the form of droplets, by imparting liquid repelling properties to the surfaces of the liquid collecting device with which the liquid makes contact.

Preferably, the image forming apparatus further comprises: a relative movement device which moves at least one of the medium supporting device and the discharging head in a direction of liquid droplet discharge of the discharging head; and a hermetic sealing device which covers a periphery of the nozzle surface and makes contact with the medium supporting device, the hermetic sealing device including an elastic member which hermetically seals the nozzle surface of the discharging head. According to this, by positioning the medium supporting device adjacently to the discharging head if necessary, and hermetically sealing the nozzle surface of the discharging head by means of the medium supporting surface of the medium supporting device and the elastic member of the hermetic sealing device, it is possible to use same as a capping device for preventing drying out when discharge is not being performed, and the like. Furthermore, the medium-supporting device according to the present composition can be used as a head liquid suctioning device for suctioning and forcibly removing liquid from the nozzles.

Preferably, the medium supporting device functions as a capping device which seals the nozzle surface of the discharging head during non-discharging periods, as well as functioning as a head liquid suctioning device which suctions liquid from the nozzles of the discharging head. According to this, it is possible to simplify the mechanisms required in order to carry out a head recovery process, and hence size reduction and cost reductions can be achieved.

Preferably, the image forming apparatus further comprises: a first cleaning device which makes contact with the nozzle surface of the discharging head; a second cleaning device which makes contact with a medium supporting surface of the medium supporting device; and a cleaning drive device which moves the first cleaning device and the second cleaning device simultaneously with respect to the nozzle surface and the medium supporting surface in a state where the first cleaning device is in contact with the nozzle surface and the second cleaning device is in contact with the medium supporting device. According to this, a cleaning device for simultaneously cleaning the nozzle surface and the medium supporting surface is provided, and it is hence possible to shorten the time required for a cleaning process.

Preferably, the first cleaning device has a first blade which wipes the nozzle surface; the second cleaning device has a second blade which wipes the medium supporting surface; the first blade and the second blade are disposed with a prescribed space in a moving direction during the cleaning by means of the cleaning drive device; and the nozzle surface is wiped by the first blade proceeding ahead in the moving direction during the cleaning, droplets are discharged from the nozzles in a nozzle region that has been wiped by the first blade, and a region of the medium supporting surface onto which the discharged droplets have adhered is wiped by the following second blade. According to this, by carrying out a discharge of droplets from the nozzles after the nozzle surface has been wiped by the first blade, it is possible to avoid the infiltration of impurities into the nozzles, and hence stabilized discharge can be achieved. Moreover, droplets adhering to the medium supporting surface and liquid discharged after the first blade can be recovered readily by means of the second blade.

In one mode of the present invention, the invention is applied to an inkjet recording apparatus comprising a full line type recording head wherein a plurality of nozzles are arranged through a length corresponding to the full width of the recording medium, and a conveyance device for causing the recording head and the recording medium to move relatively with respect to each other, by conveying at least one of the recording head and the recording medium in a direction substantially orthogonal to the width direction of the recording medium.

A "full line type recording head (discharging head)" is usually disposed following a direction that is orthogonal to the relative direction of conveyance of the recording medium (direction of relative movement), but modes may also be adopted wherein the recording head is disposed following an oblique direction that forms a prescribed angle with respect to the direction orthogonal to the direction of relative movement. Furthermore, the arrangement of the nozzles (image recording elements) in the recording head is not limited to being a single line type arrangement, and a matrix arrangement comprising a plurality of rows may also be adopted. Moreover, a mode may also be adopted wherein a row of nozzles corresponding to the full width of the recording paper is constituted by combining a plurality of short dimension recording head units having nozzle rows which do not reach a length corresponding to the full width of the recording medium.

"Recording medium" indicates a medium on which an image is recorded by means of the action of the recording head (this medium may also be called a print medium, image forming medium, image receiving medium, or the like), and this term includes various types of media, of all materials and sizes, such as continuous paper, cut paper, sealed paper, resin sheets, such as OHP sheets, film, cloth, a printed circuit board whereon a wiring pattern, or the like, is printed by means of an inkjet recording apparatus, and other materials.

In the present specification, the term "printing" indicates the concept of forming images in a broad sense, including text.

The movement device (conveyance device) for causing the recording medium and the recording head to move relative to each other may include a mode where the recording medium is conveyed with respect to a stationary (fixed) recording head, or a mode where a recording head is moved with respect to a stationary recording medium, or a mode where both the recording head and the recording medium are moved.

According to this, since a liquid collecting device having inclined surfaces along which liquid can slide and openings for transmitting liquid is provided in the medium supporting device which supports a recording medium, and since the liquid collected by the liquid collecting device is suctioned via the openings in the liquid collecting device, from the rear side of the medium supporting device, then it is possible readily to collect ink generated by preliminary discharge, or surplus ink from printing of borderless images, or the like, and hence liquid removal characteristics can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Configuration of an Inkjet Recording Apparatus

Figure 1:
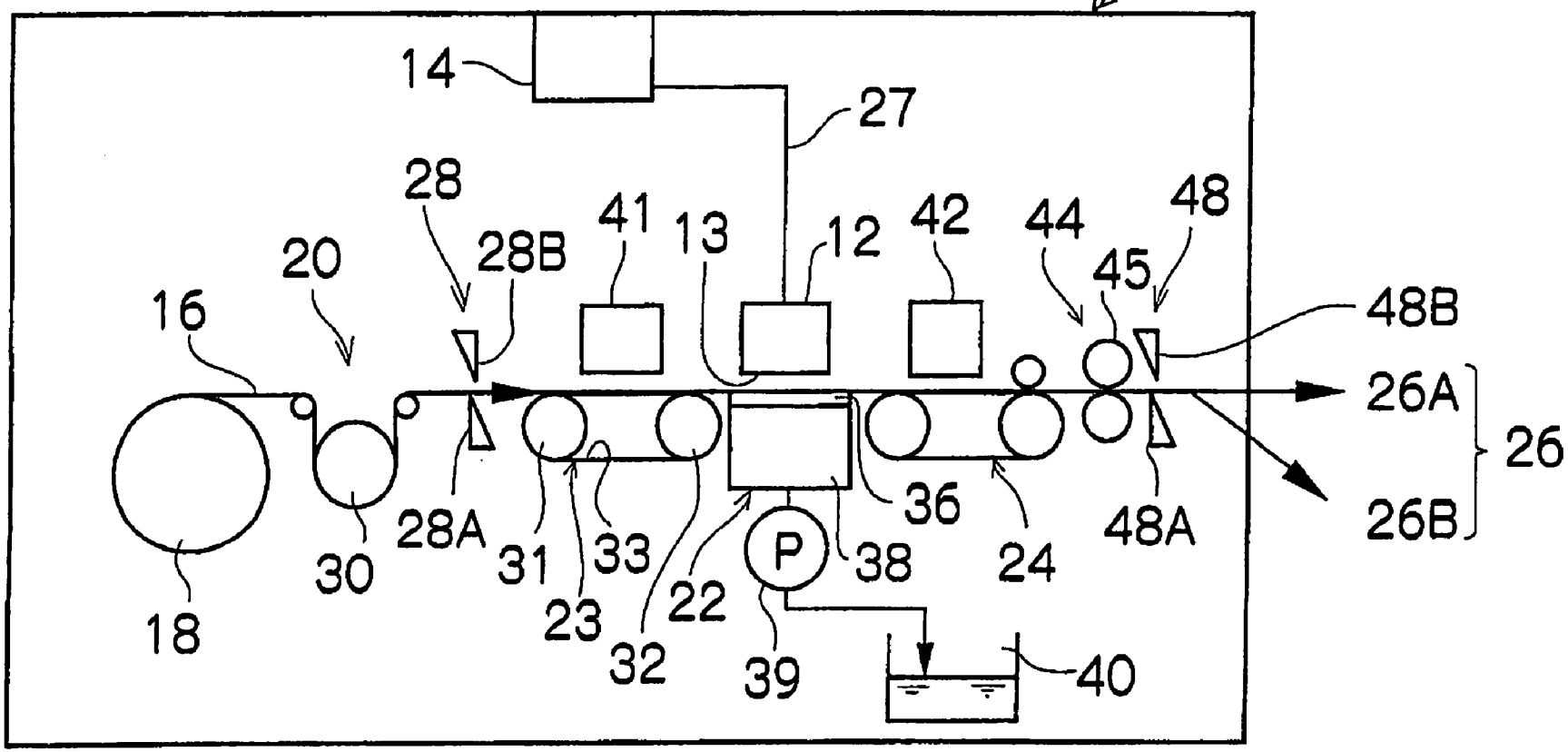
FIG. 1 is a general compositional diagram showing an inkjet recording apparatus relating to an embodiment of the present invention.

FIG. 1 is a diagram of the general composition of an inkjet recording apparatus according to an embodiment of the present invention. As shown in FIG. 1, this ink-jet recording apparatus 10 comprises a print head 12, an ink storing/loading unit 14, a paper supply unit 18 for supplying recording paper 16 as a recording medium, a decurling processing unit 20 for removing curl in the recording paper 16, a supporting section 22, disposed in a position opposing the nozzle surface (ink discharge surface) 13 of the print head 12, for supporting the recording paper 16 while maintaining the recording paper 16 in a flat state, conveyance units 23, 24 for conveying the recording paper 16, and a paper output unit 26 for discharging the recording paper after recording (the printed object). To simplify the description, only one print head 12 (for one color) is depicted, but if a color image is to be formed, then a plurality of print heads corresponding respectively to a plurality of colors (for example, four colors such as cyan, magenta, yellow, and black, or multiple colors including light cyan, light magenta, or the like additionally) are provided.

Furthermore, it is also possible to provide only one print head having discharge ports for respective colors. Desirably, a plurality of the supporting sections 22 are provided for the plurality of colors, respectively. According to this mode, each ink is directed to a recovery tank 40 provided for each color through ink collecting holes 60 described hereinafter (not shown in FIG. 1, but shown in FIG. 6), and hence the inks divided into respective colors can be reused.

The ink storing/loading unit 14 has an ink tank for storing the ink to be supplied to the print head, and the ink tank is connected to the print head through a channel 27. The ink storing/loading unit 14 has a warning device (e.g., a display device, an alarm sound generator) for warning when the remaining amount of ink is low, and has a mechanism for preventing loading errors among the colors.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper can be used, it is preferable that a information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

The decurled and cut recording paper 16 is delivered to conveyance unit 23. The conveyance unit 23 has a configuration in which an endless belt 33 is set around rollers 31 and 32.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1. Furthermore, the conveyance unit 24 disposed on the downstream side of the supporting section 22 is the composition similarly to the conveyance unit 23.

The supporting section 22 is composed of a platen 36 and an ink-receiving unit 38. The platen 36 having the plurality of ink collecting holes 60 (not shown in FIG. 1, but shown in FIG. 6) is disposed on the upper face of supporting section 22 (the supporting face to support the recording paper 16), and the under side of the platen 36 is connected to the ink-receiving unit 38.

A suction pump (negative pressure generating device) 39 is connected to the ink-receiving unit 38 as device for generating suction force, and it is possible to suck in the recording paper 16 and the nozzle of print head 12, or the like, by suctioning of the suction pump 39 to the supporting section 22 and the nozzle of print head 12. The ink recovered in the ink-receiving unit 38 is sent to a collection tank 40 through the suction pump 39. All color inks may be collected in the same collection tank 40; however, it is preferable to collect the color inks to the corresponding collection tanks, respectively. By comprising such a mode, it is possible to reutilize collective inks. Particulars about the supporting section 22 are described later.

A heating fan 41 is disposed on the upstream side of the printing unit 12 in the conveyance pathway. The heating fan 41 blows heated air onto the recording paper 16 to heat the recording paper 16 immediately before printing so that the ink deposited on the recording paper 16 dries more easily.

A post-drying unit 42 is disposed on the downstream side of the print head 12. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively.

Although not shown in FIG. 1, a sorter for collecting prints according to print orders is provided to the paper output unit 26A for the target prints.

Structure of the Print Head

Figure 2A:
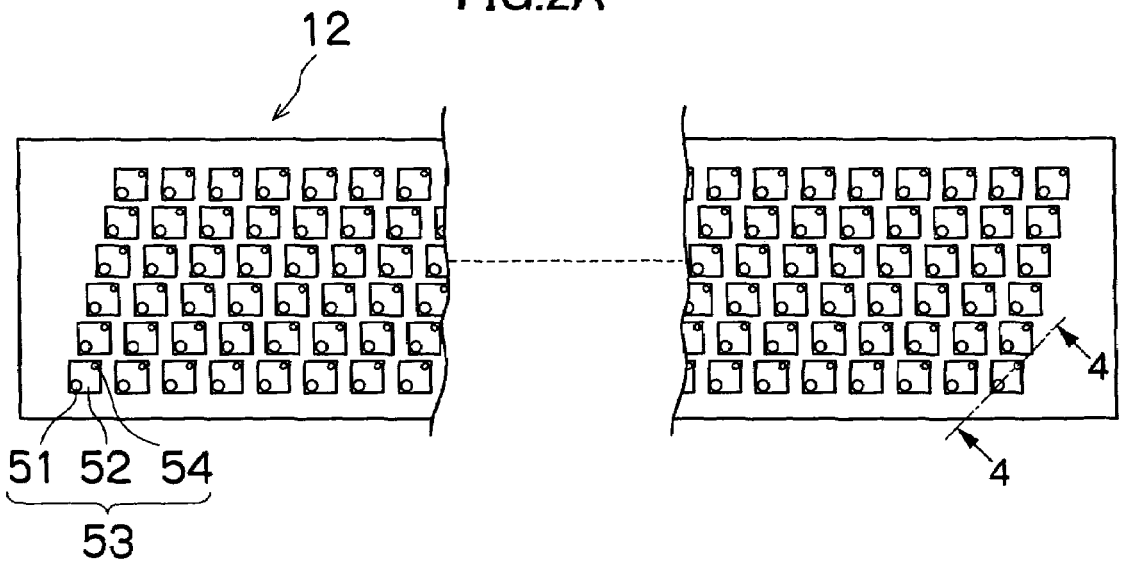
FIGS. 2A and 2B are plan view perspective diagrams showing an example of the composition of a print head.
Figure 2B:
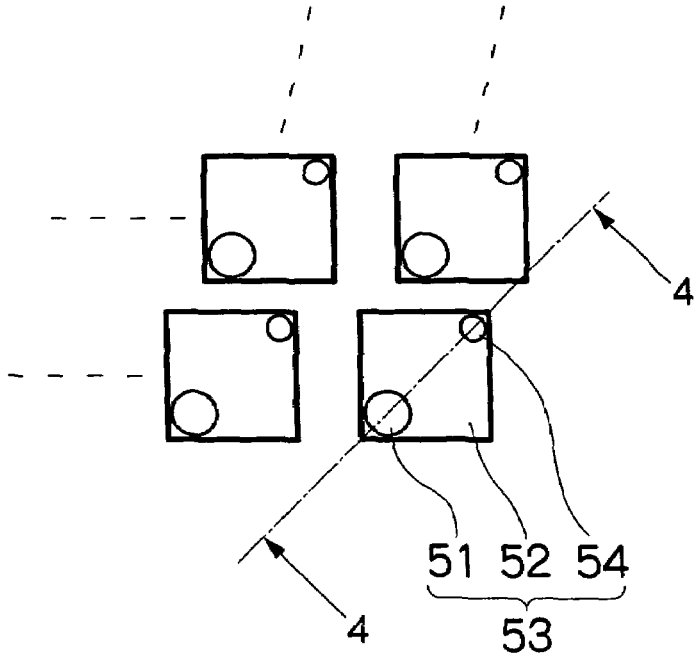
Figure 3:
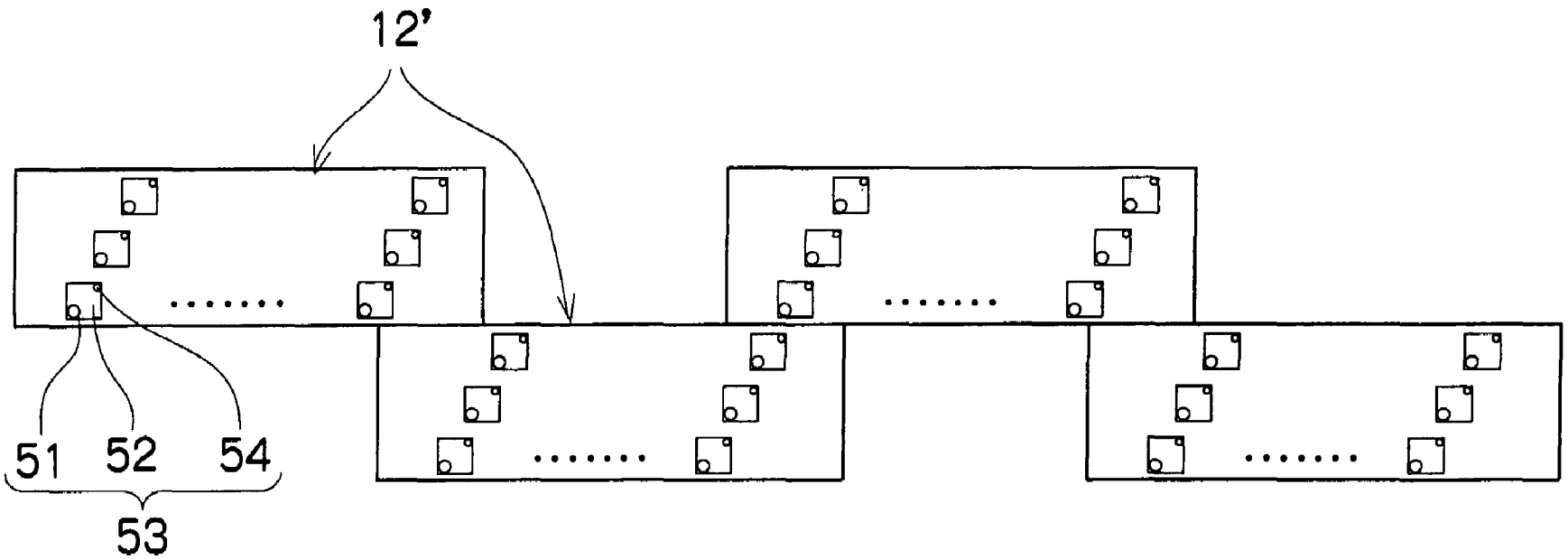
FIG. 3 is a plan view perspective diagram showing a further example of the composition of a print head.
Figure 4:
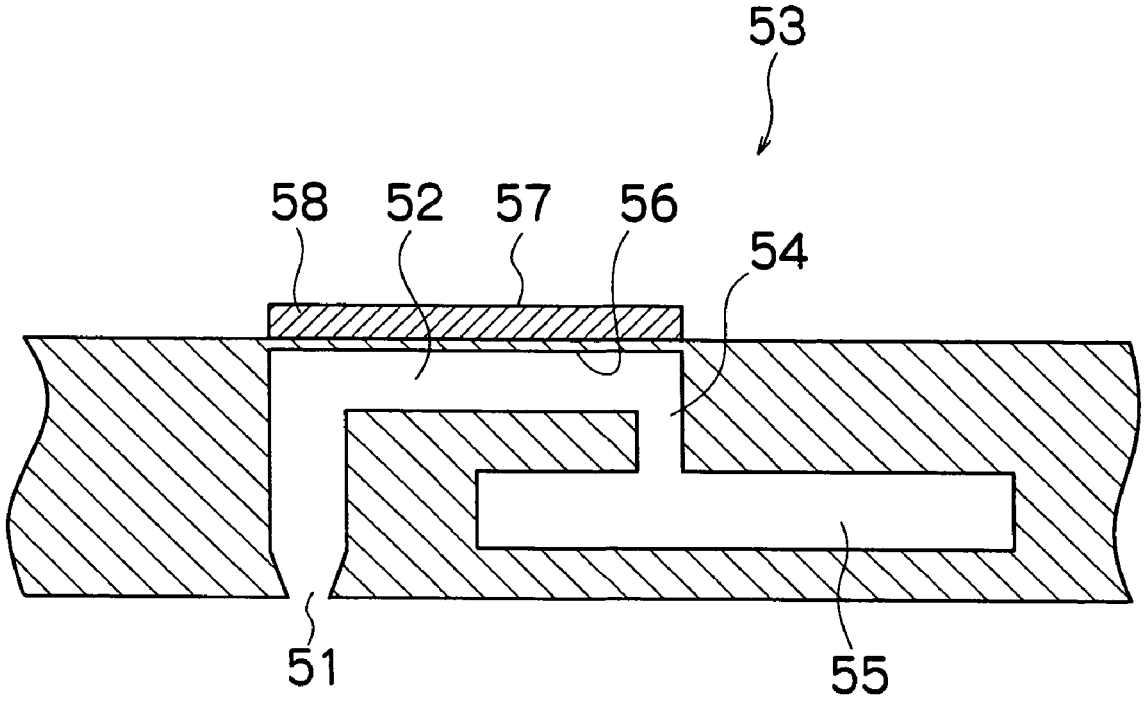
FIG. 4 is a cross-sectional view along line 4-4 in FIG. 2.

FIG. 2A is a perspective plan view showing an example of the configuration of the print head 12, FIG. 2B is an enlarged view of a portion thereof, FIG. 3 is a perspective plan view showing an example of the other configuration of the print head 12, and FIG. 4 is a cross-sectional view taken along the line 4-4 in FIGS. 2A and 2B, showing the inner structure of an ink chamber unit. The nozzle pitch in the print head 12 should be minimized in order to maximize the density of the dots printed on the surface of the recording paper. As shown in FIGS. 2A, 2B, 3 and 4, the print head 12 in the present embodiment has a structure in which a plurality of ink chamber units 53 including nozzles 51 for ejecting ink-droplets and pressure chambers 52 connecting to the nozzles 51 are disposed in the form of a staggered matrix, and the effective nozzle pitch is thereby made small.

As shown in FIGS. 2A and 2B, the print head 12 of the present embodiment is one or more line head in which a plurality of nozzles 51 are arrayed across a length corresponding to whole length of the recording paper 16 (recording matter).

Furthermore, in place of FIG. 2, it is also possible to compose a full line type head having nozzle rows of a length corresponding to the full width of the recording medium, by mutually joining up short head units 12', wherein a plurality of nozzles 51 are arranged in a two-dimensional fashion, in a staggered matrix arrangement, as shown FIG. 3.

The planar shape of the pressure chamber 52 provided for each nozzle 51 is substantially a square, and the nozzle 51 and supply port 54 are disposed in both corners on a diagonal line of the square. As shown FIG. 4, each pressure chamber 52 is connected to a common channel 55 through a supply port 54. The common channel 55 is connected to an ink tank as resource of ink, the ink supplied from ink tanks is distributed and supplied to each pressure chambers 52 through the common channel 55. Furthermore, between the ink tanks and the common channel 55, it is preferable to provide a sub-tank (not shown) integrally to the print head 50 or nearby the print head 50. The sub-tank has a damper function for preventing variation in the internal pressure of the head and a function for improving refilling of the print head.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
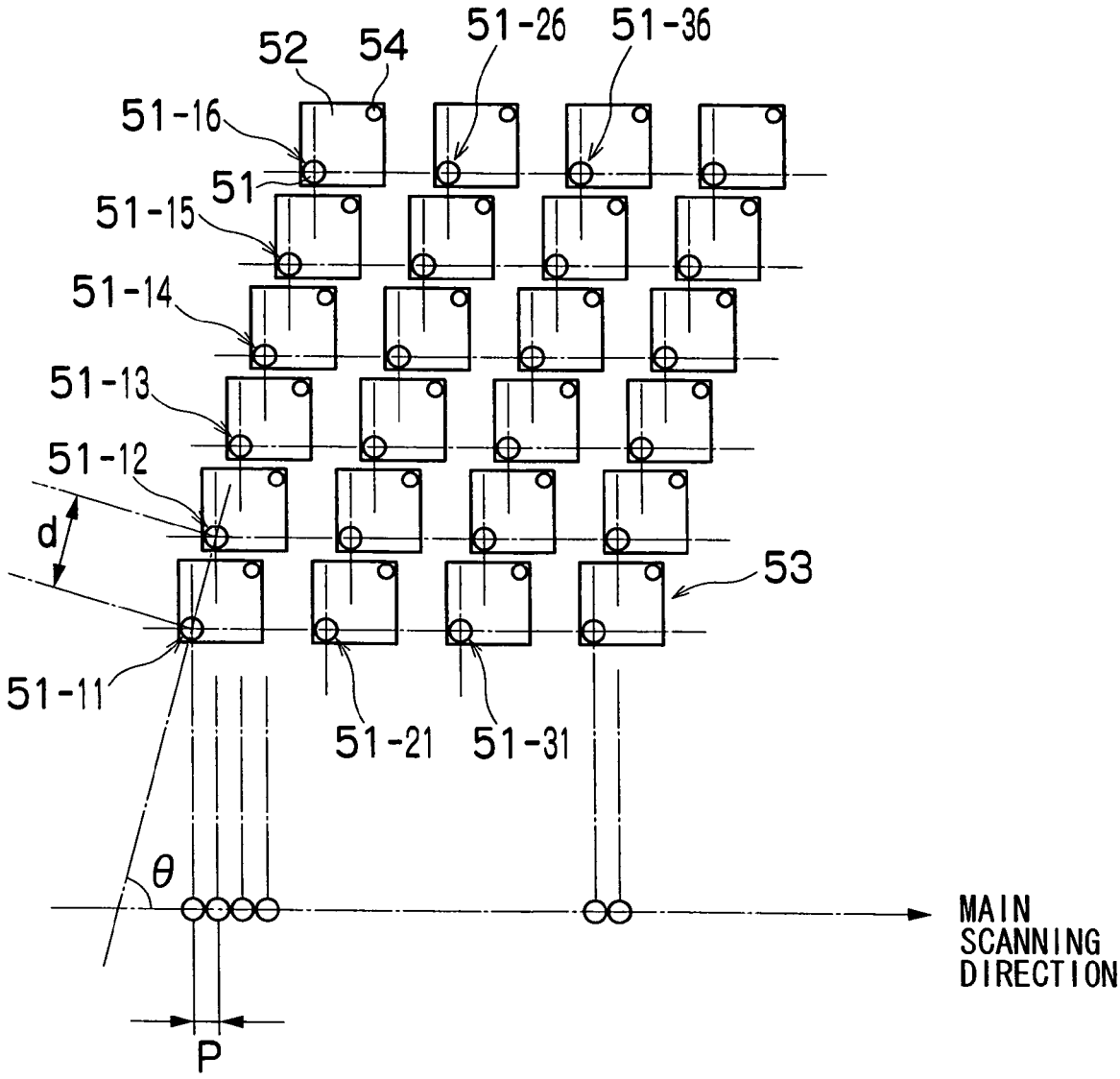
FIG. 5 is an enlarged view showing a nozzle arrangement in the print head illustrated in FIG. 2.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5. With the structure in which the plurality of rows of ink chamber units 53 are arranged at a fixed pitch d in the direction at the angle θ with respect to the main scanning direction, the nozzle pitch P as projected in the main scanning direction is $d \times \cos\theta$.

Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch.

In a full-line head comprising rows of nozzles that have a length corresponding to the maximum width of sheet (the recording paper 16), the "main scanning" is defined as to print one line or one zonal printing in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper 16 by sequentially driving the nozzles 51-11, 51-12, . . . , 51-16 in accordance with the conveyance velocity of the recording paper 16.

On the other hand, the "sub-scanning" is defined as to repeatedly perform printing of one line or one zonal printing formed by the main scanning, while moving the full-line head and the recording paper relatively to each other.

When no ink is discharged from the nozzles 51 of the print head 50 over a certain amount of time, the ink solvent near the nozzles evaporates, the viscosity of the ink near the nozzles increases, and ink cannot be discharged from the nozzles 51 even when the actuator 58 operates. Therefore, before such circumstances occur (while the viscosity allows the possibility of discharge by the actuator 58), the actuator 58 is operated to receive the ink, and "preliminary discharge" is performed, in which the ink near the nozzles with increased viscosity is discharged. Also, after stains on the nozzle surface are washed off by a cleaning blade or another such wiper (not shown) provided as a washing device for the nozzle surface, a preliminary discharge is performed to prevent impurities from getting mixed in the nozzle due to the rubbing operation of the wiper. The preliminary discharge is also sometimes referred to as "empty discharge," "purging," "liquid discharge," or the like.

When the increasing viscosity of the ink in the nozzles 51 exceeds a certain level, the suction operation described below is performed because the ink cannot be discharged by the above-mentioned preliminary discharge.

Specifically, when air bubbles become mixed in the nozzles 51 and in the ink in the pressure chambers 52, the ink cannot be discharged form the nozzles 51 even when the actuator 58 operates. The ink cannot be discharged form the nozzles 51 even when the actuator 58 operates also when the viscosity of the ink in the nozzles 51 exceeds a certain level. In such a case, a suction device for drawing out the ink in the pressure chambers 52 with a pump or the like is provided to the nozzle surface, and bubbled or thickened ink is suctioned out.

However, the suction operation described above consumes a large amount of ink because it is performed for all the ink in the pressure chambers 52. Therefore, it is preferable to perform the preliminary discharge, if possible, when the increase in viscosity is low.

In the implementation of the present invention, the structure of the nozzle arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Structure of the Supporting Section

Figure 6:
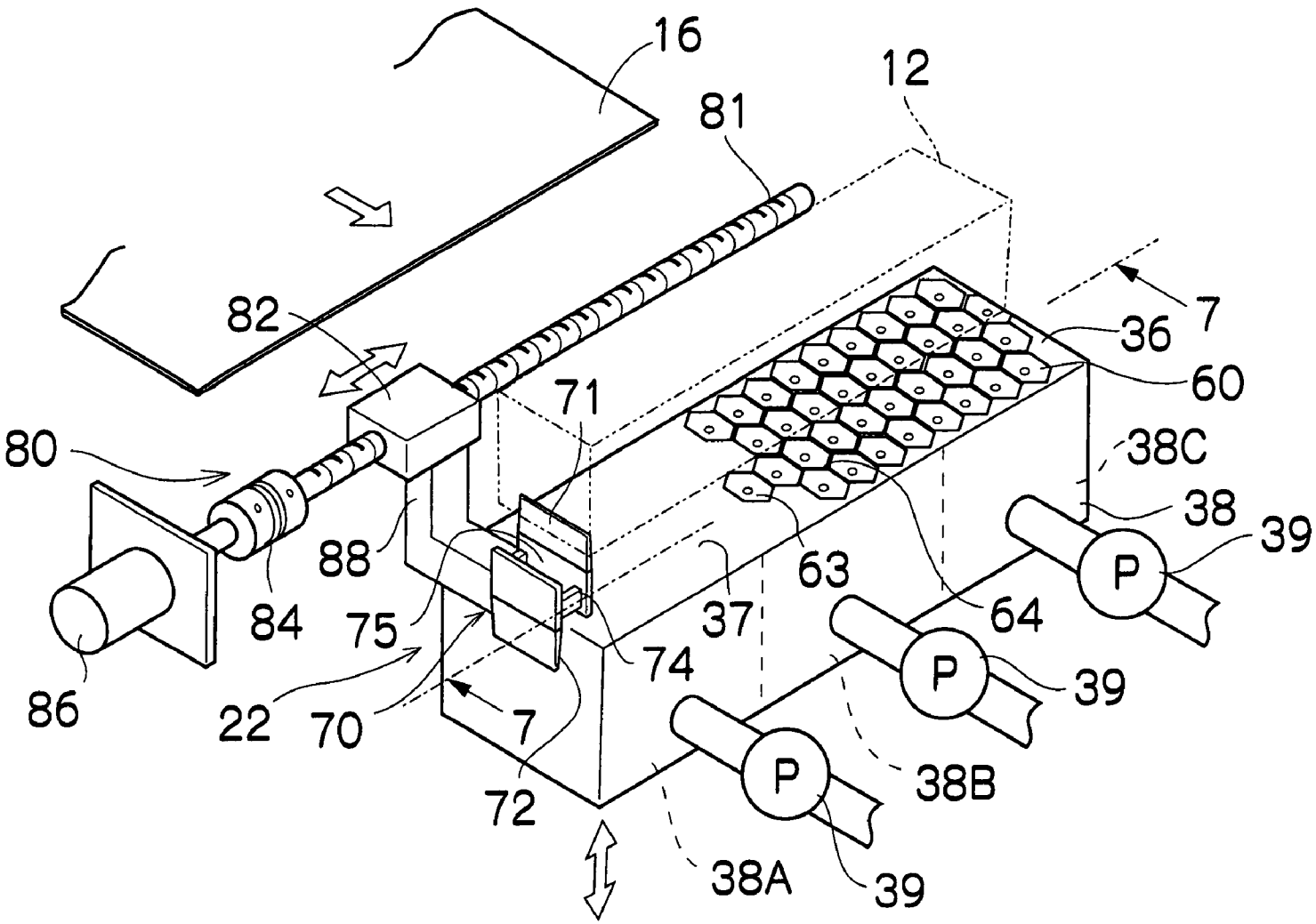
FIG. 6 is a perspective diagram showing the structure of a supporting section for supporting recording paper, at a position opposing the nozzle surface of a print head.
Figure 7:
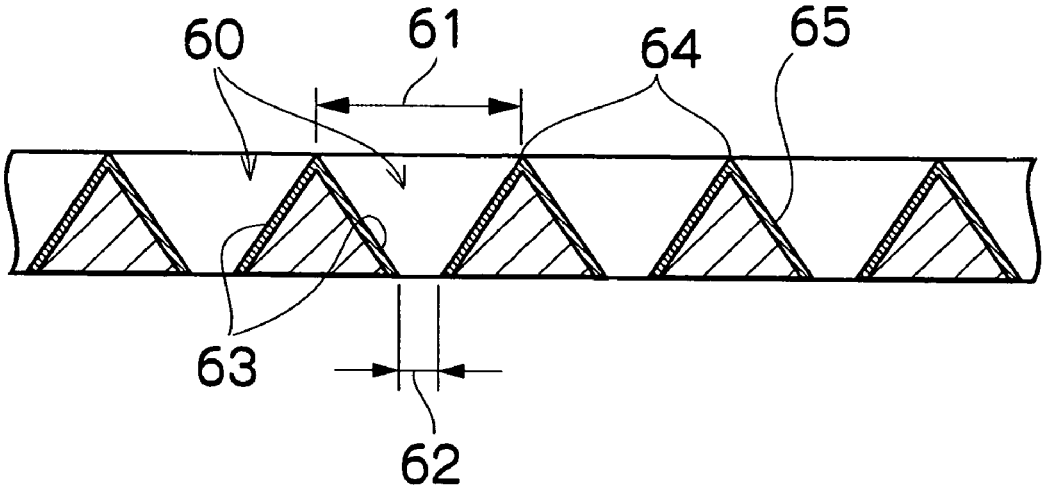
FIG. 7 is a cross-sectional view along line 7-7 in FIG. 6.

FIG. 6 is a perspective view showing the structure of the supporting section 22 described in FIG. 1, and FIG. 7 is a cross-sectional diagram along line 7-7 in FIG. 6. As shown in FIG. 6, a plurality of ink collecting holes 60 are formed over the entire surface of a platen 36 disposed on the upper face of the supporting section 22. The surface of the platen 36 containing ink collecting holes 60 has liquid repelling properties which repel the ink. Here, "liquid repelling characteristics" means a surface state wherein the angle of contact of the ink droplets is greater than 90°, and more desirably, a surface state wherein this angle is 120° or above. In order to impart liquid repelling characteristics to the platen 36, the platen 36 may be fabricated from a liquid repelling material, or it may be provided with a liquid repelling treatment on the surface of the platen 36. The liquid repelling treatment is a surface treatment which imparts an action of repelling the ink, and by means of this treatment, a liquid repelling layer (ink repelling layer) 65 is formed on the target region. For example, the target region is coated with a fluorine compound by spray-coating.

As shown in FIG. 7, the ink collecting holes 60 are pierced in the direction of the thickness of the platen 36, and the openings 61 thereof on the discharge side opposing the nozzle surface 13 of the print head 12 (the openings on the side of the surface supporting the recording paper 16) are broad, whereas the openings 62 on the rear side of the platen 36 (the recovery side) are narrower openings than the openings 61 on the discharge side, for easy concentration of liquid. Since the portion from the edge of the opening 61 on the discharge side to the edge of the opening on the recovery side (under side) forms an inclined surface (slope) 63 along which ink droplets can slide downwards, then an ink droplet having fallen onto the inclined surface 63 slides down the inclined surface 63, which has ink repelling properties, and thus moves towards the opening 62 on the under side. Furthermore, in FIG. 7, the inclined surface 63 inclined in a planar fashion is depicted, but in implementing the present invention, it is also possible for the inclined surface 63 to be constituted by a curved surface.

Moreover, the ink collecting holes 60 also have a function as suction holes whereby the recording paper 16 is suctioned, and the recording paper 16 is suctioned onto the platen 36 by means of the negative pressure of the suction pump 39 illustrated in FIG. 6. In this case, the recording paper 16 makes contact with and is held by the ridges 64 surrounding the perimeters of the ink collecting holes 60 onto the platen 36.

In this example, the shape demarcated by the ridge lines surrounding the perimeters of the ink collecting holes 60 is a hexagonal shape, the implementation of the present invention is not limited to this example, and any desired shaped (polygonal shape, circular shape, elliptical shape, or the like) may be adopted. Furthermore, the mode for arranging a plurality of ink collecting holes 60 in a planar fashion (a two-dimensional arrangement) is not limited to a honeycomb type arrangement as illustrated, and it is also possible to adopt a square matrix arrangement wherein the row direction and column direction intersect orthogonally, or a staggered matrix arrangement wherein the row direction and the column direction do not intersect orthogonally, or the like.

In this case, as shown in FIG. 6, desirably, a mode is adopted wherein the ink collecting holes 60 are shaped in such a manner that there are no ridge lines which are orthogonal to the paper conveyance direction. More specifically, in the case of ink collecting holes 60 having the hexagonal shape as illustrated in FIG. 6, the ink collecting holes 60 are disposed in such a manner that none of the edges of the hexagonal shape lie orthogonally with respect to the paper conveyance direction. Thereby, it is possible to improve both the supporting characteristics and the conveyance characteristics of the recording paper 16.

Furthermore, desirably, a positional arrangement is adopted wherein the nozzle arrangement pattern in the print head 12 and the arrangement pattern of the ink collecting holes 60 opposing same are made to coincide with each other, such that the positions of the nozzles 51 and the positions of the ink collecting holes 60 are mutually corresponding. By means of this mode, it is possible to collect ink reliably into the ink collecting holes.

The interior of the ink-receiving unit 38 is divided into a plurality of regions in the longitudinal direction of the print head 12 (in FIG. 6, it is divided into three regions), and each of these respective divided regions 38A, 38B and 38C functions as a suction chamber. The respective divided regions 38A to 38C are connected respectively and independently to a suction pump 39. By controlling the respective suction pumps 39, it is possible to selectively suction a desired one of the divided regions 38A to 38C of the ink-receiving unit 38. Naturally, it is also possible to suction all of the divided regions 38A to 38C simultaneously.

By means of this composition, it is possible to achieve an apparatus using the suction pump 39 that is relatively small (of relatively small capacity). Moreover, it is also possible to halt the driving of the suction pump 39 corresponding to a suction area that is not required in accordance with the size, or the like of the recording paper 16 being used.

According to the present embodiment, ink that is not used in image recording, of the ink discharged from the print head 12, (namely, ink mist that discharge outside the region of the recording paper 16 and falls down onto the platen 36) enters into the ink receiving unit 38, via the ink collecting holes 60 in the platen 36, due to the negative pressure action of the suction pump 39, and this ink is then supplied to the recovery tank 40, via the suction pump 39.

Therefore, for example, it is possible to recover ink mist from the edge regions in the case of borderless printing (ink discharged outside the region of the recording paper 16), or ink mist (purge mist) from preliminary discharge implemented in order to prevent drying of the meniscus (the boundary face between the ink and the external air) in the nozzles 51.

Moreover, according to the present embodiment, since the negative pressure generating device (the suction pump 39) used in the ink mist recovery device also functions as a device for generating the negative pressure required for suctioning the recording paper 16, then it is possible to simplify the mechanism of the device, and hence reductions in size and cost can be achieved.

The supporting section 22 according to the present embodiment is supported on a raising and lowering mechanism (not illustrated), and is able to move in the ink discharge direction of the print head 12 (the direction perpendicular to the nozzle surface 13). In other words, the supporting section 22 is able to move upwards and downwards with respect to the nozzle surface 13 of the print head 12, and it can be halted in respective positions, such as "normal position", "cleaning position", and "capping position", according to requirements. "Normal position" indicates a platen position wherein the clearance between the nozzle surface 13 and the recording paper 16 is maintained at a prescribed distance suitable for printing. "Cleaning position" indicates a position set for a cleaning operation (described hereinafter), and it is lower than the normal position. "Capping position" indicates a position set for a capping operation (described hereinafter) (including a suctioning operation), and it is higher than the normal position.

Furthermore, the inkjet recording apparatus 10 according to the present example comprises a blade 70 for simultaneously cleaning the nozzle surface 13 of the print head 12 and the upper face of the platen 36 (also called the supporting surface for the recording paper 16 and hereinafter referred to as "platen surface 37"), and a blade travel mechanism 80 for causing the blade 70 to move following the longitudinal direction of the print head 12 (the direction orthogonal to the conveyance direction of the recording paper 16). The blade 70 has a structure wherein a first blade 71 for wiping across the nozzle surface 13 and a second blade 72 for wiping across the platen surface 37 are combined in upper and lower positions parallel to the shorter dimension direction of the head and at a prescribed distance apart in the longitudinal direction of the head, and the first blade 71 and the second blade 72 both have a blade width that is substantially equal to the width of the recording head 12 in the direction of the shorter dimension thereof. Desirably, the blade width is at least equal to or greater than the nozzle arrangement range in the shorter dimension direction of the print head 12, and at maximum, it is sufficient if it is equal to the width of the recording head 12 in the shorter dimension direction thereof.

Moreover, a coupling member 74 for connecting the first blade 71 and the second blade 72 has an ink transmitting hole 75 passing in the ink discharge direction.

The blade travel mechanism 80 according to the present example is constituted by a ball screw 81 and a slider 82 which screws onto same. The ball screw 81 is disposed in such a manner that the axial direction thereof coincides with the longitudinal direction of the print head 12, and it is connected to the rotating shaft of a motor 86, via a coupling 84. The other end of the ball screw 81 is supported by a bearing (not illustrated).

The blade 70 is installed on an arm 88, and the base end portion of the arm 88 is fixed to a slider 82. When the ball screw 81 is rotated by the motor 86, the slider 82 moves over the ball screw 81, and in accordance with this movement, the blade 70 travels between the print head 12 and the platen 36.

The blade travel mechanism 80 is not limited to one based on a ball screw and nut system such as that illustrated, and it is also possible to adopt a direct drive mechanism based on another system, such as a belt drive system, and a linear motor system.

Figure 8:
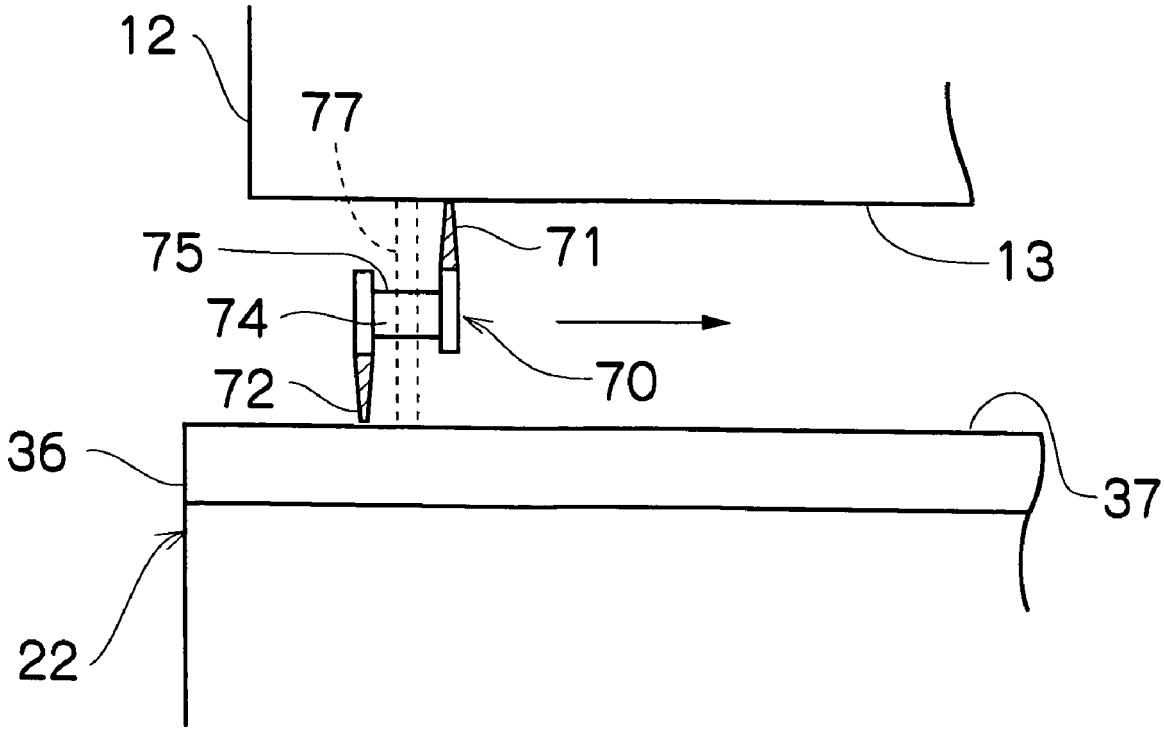
FIG. 8 is a side view showing a state during a cleaning operation.

FIG. 8 is a principal side view showing a state during a cleaning operation. This diagram shows a view of the print head 12 as observed from the downstream side of the host computer 12 towards the upstream side, and in FIG. 8, the direction perpendicular to the surface of the drawing sheet towards the front side from the rear side represents the direction of conveyance of the recording paper 16 (not illustrated in FIG. 8), and the left to right direction of the drawing sheet surface represents the longitudinal direction of the print head 12.

As shown in FIG. 8, during cleaning, the supporting section 22 is moved to a cleaning position, and the blade 70 is introduced in between the print head 12 and the supporting section 22. The first blade 71 and the second blade 72 are moved from left to right in FIG. 8, while respectively rubbing across the nozzle surface 13 and the platen surface 37.

During this movement of the blade, preliminary discharge for discharging ink from the nozzles 51 of the print head 12 is carried out in accordance with the position of the blade 70. This preliminary discharge is carried out successively at the nozzles 51 entering within the range of the opening of the ink transmission hole 75 in the blade 70.

More specifically, firstly, the first blade 71 proceeds in the moving direction of the blade 70 and wipes the nozzle surface 13, and immediately after this wiping action, a preliminary discharge is carried out from the nozzles 51. The ink 77 discharged by this preliminary discharge operation falls onto the platen 36, by passing through the ink transmission hole 75. The ink that has fallen onto the platen 36 is recovered in the ink receiving section 38, due to the negative pressure of the suction pump 39, and the platen 36 is wiped by the second blade 72 which follows in a subsequent position. This series of operations is carried out over the entire range of the longitudinal direction of the print head 12, as the blade 70 travels along same. Therefore, it is possible to clean the nozzle surface 13 and the platen surface 37, simultaneously, by means of a single traveling movement of the blade (in one direction).

Figure 9:
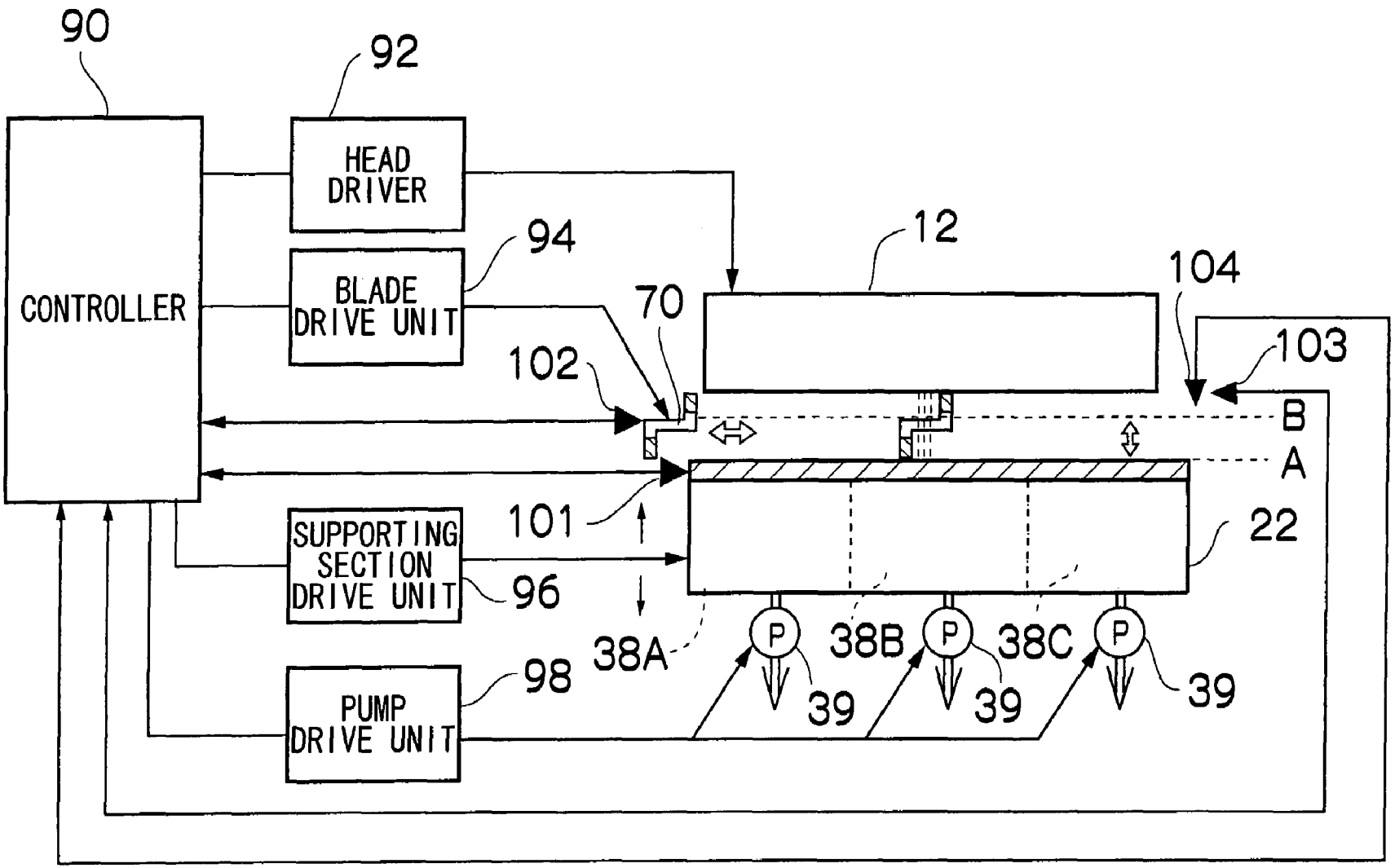
FIG. 9 is a compositional diagram of a control system relating to a cleaning operation.
Figure 10:
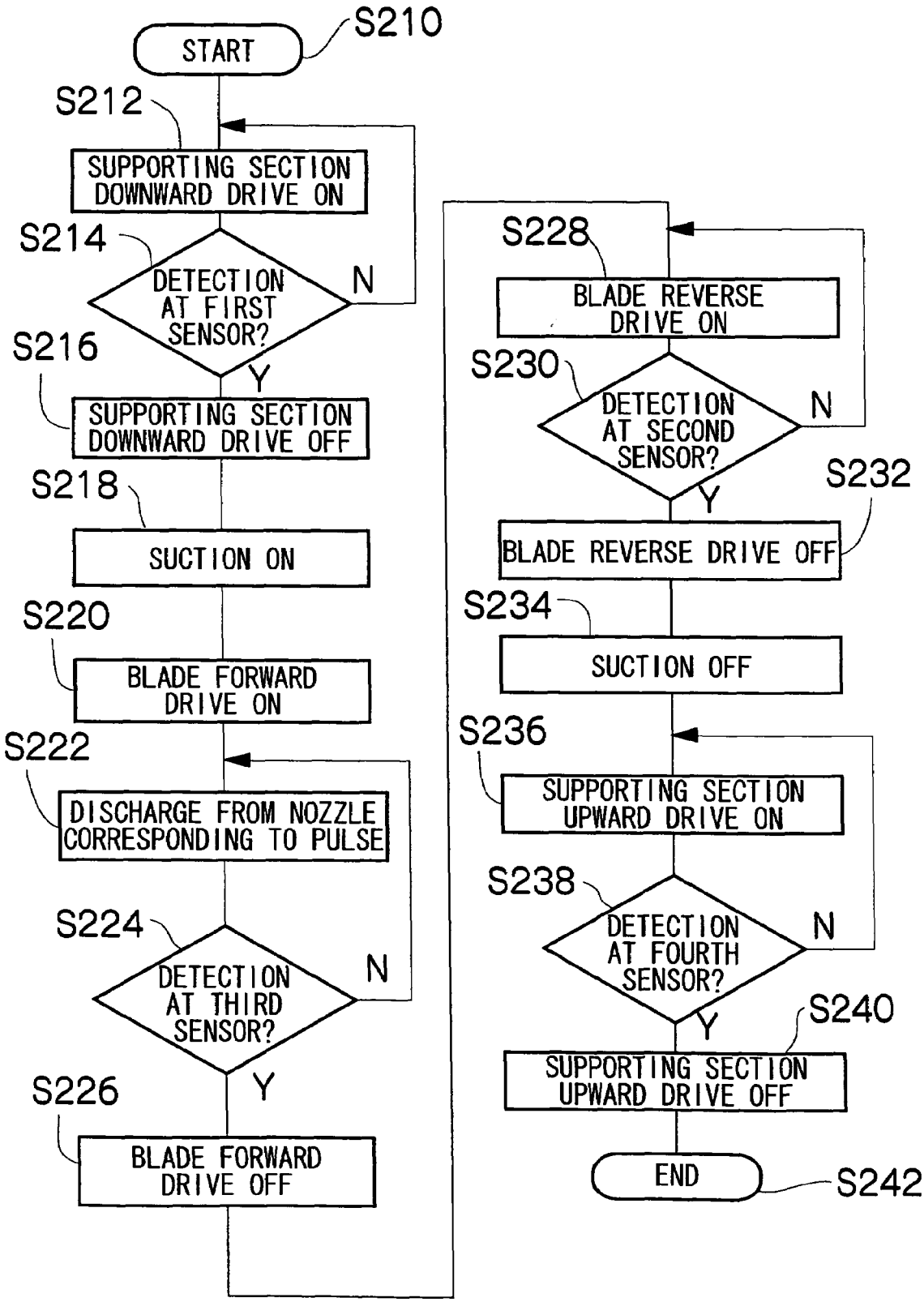
FIG. 10 is a flowchart showing a control procedure for a cleaning operation.

FIG. 9 is a compositional diagram of a control system relating to a cleaning operation, and FIG. 10 is a flowchart showing the corresponding control procedure. As shown in FIG. 9, the inkjet recording apparatus 10 comprises a controller (control unit) 90 for controlling the entire system, a head driver 92, a blade drive unit 94, a supporting section drive unit 96, and a pump drive unit 98, and furthermore, it also comprises a first sensor 101 for detecting the position of the supporting section 22 when in the cleaning position A in FIG. 9, a second sensor 102 for detecting the home position of the blade 70, a third sensor 103 for detecting the travel limit position of the blade 70, and a fourth sensor 104 for detecting the position of the supporting section 22 when in the normal position B in FIG. 9.

The controller 90 is constituted by a central processing unit (CPU) and peripheral circuits relating to same, and it is a control device for generating control signals for controlling the respective units. Moreover, this controller 90 has a signal processing function for generating a signal for controlling discharge (dot data), and the dot data thus generated is supplied to the head driver 92.

The head driver 92 drives the actuator 58 of the nozzles 51 in accordance with the dot data supplied from the controller 90. More specifically, the ink discharge amount and the discharge timing for each nozzle 51 are controlled via the head driver 92, on the basis of the dot data, and hence the desired dot size and dot arrangement are achieved. A feedback control system for maintain uniform driving conditions in the head may also be incorporated into the head driver 92.

The blade drive unit 94 is constituted by a motor 86 which causes the blade 70 to travel and a driving circuit for same, and it causes the blade 70 to move in accordance with a command from a controller 90. The supporting section drive unit 96 is constituted by a motor (not illustrated) which causes the supporting section 22 to be raised and lowered and a driving circuit for same, and it causes the supporting section 22 to move in accordance with a command from a controller 90. The pump drive unit 98 is constituted by a drive circuit for driving the suction pumps 39 connected to the liquid receiving sections 38 of the supporting section 22, and it causes the suction pumps 39 to operate in accordance with the commands from the controller 90.

The first sensor 101 is a device for detecting whether or not the supporting section 22 has arrived at the cleaning position. The second sensor 102 is a device for detecting whether or not the blade 70 has arrived at a prescribed home position outside the print head 12. The third sensor 103 is a device for detecting whether or not the supporting section 22 has arrived at the normal position. The fourth sensor 104 is a device for detecting whether or not the blade 70 has arrived at a travel limit (end) in the longitudinal direction of the print head 12. The detection signals from these respective sensors 101 to 104 are input to the controller 90, and are used to control the operation.

In the foregoing composition, the following operations are performed during cleaning.

As shown in FIG. 10, when the cleaning sequence starts (step S210), firstly, a downward drive on command is issued to the supporting section 22 drive unit 96, and the supporting section 22 is lowered, in order to move the supporting section 22, which is in the normal position, to the cleaning position (step S212). Next, the controller 90 monitors the detection signal from the first sensor 101 and judges whether or not a detection signal has been obtained from the first sensor 101 (step S214).

If the supporting section 22 has not reached the cleaning position, then at step S214, a NO verdict is returned, and the sequence returns to step S212 and the downward movement continues.

When the supporting section 22 reaches the cleaning position, a YES verdict is returned at step S214. In this case, the controller 90 halts the supporting section 22 by issuing a downward drive off command to the supporting section drive unit 96 (step S216). Thereupon, the suction pump 39 is operated and the interior of the supporting section 22 is set to negative pressure (step S218).

Next, a forward drive on command is issued to the blade drive unit 94 for driving the blade 70 in a cleaning direction, and hence the blade 70 is caused to travel (step S220). This blade operation is carried out by inputting pulses to a motor 86.

Furthermore, the nozzles 51 are driven in accordance with the pulses of the motor 86, in synchronism with the driving of the blade 70, and preliminary discharge as described in FIG. 8 is carried out (step S222 in FIG. 10). This nozzle driving is carried out on the basis of a previously prepared data map.

During the execution of the aforementioned cleaning operation, the controller 90 judges whether or not a detection signal has been obtained from the third sensor 103 (step S224). If the supporting section 70 has not reached the travel limit, then at step S224, a NO verdict is returned, the sequence returns to step S222, and the aforementioned cleaning operation continues.

On the other hand, if the blade 70 has reached the travel limit at the end of the print head 12, then at step S224, a YES verdict is returned. In this case, the controller 90 halts the blade 70 by issuing a blade forward drive off command to the blade drive unit 94 (step S226).

Thereupon, a blade reverse drive on command is issued to the blade drive unit 94, and the blade 70 is caused to move towards its original position (home position) (step S228). The first blade 71 is composed in such a manner that it can be raised and lowered by means of an actuator, or the like (not illustrated), whereby, in this returning movement (reverse travel), the first blade 71 is prevented from making contact with the nozzle surface 13 of the print head 12, and the first blade is thus caused to move in a separated state from the nozzle surface 13. Alternatively, it can be separated by driving the supporting section downwards.

During the aforementioned movement driving operation, the controller 90 judges whether or not a detection signal has been obtained from the second sensor 102 (step S230). If the blade 70 has not reached the home position, then at step S230, a NO verdict is returned, the sequence returns to step S228 and the aforementioned returning movement of the blade 70 continues.

When the blade 70 reaches the home position, a YES verdict is returned at step S230. In this case, the controller 90 halts the blade 70 by issuing a blade reverse drive off command to the blade drive unit 94 (step S232), and the suction pumps 39 are halted (step S234).

Thereafter, an upward driven on command is issued to the supporting section drive unit 96, and the supporting section 22 is raised (step S236). When the upward drive has started, the controller 90 judges whether or not a detection signal has been obtained from the fourth sensor 104 (step S238).

If the supporting section 22 has not reached the normal position, then at step S238, a NO verdict is returned, and the sequence returns to step S236 and the upward movement continues.

When the supporting section 22 reaches the normal position, a YES verdict is returned at step S238. In this case, the controller 90 halts the supporting section 22 by issuing an upward drive off command to the supporting section drive unit 96 (step S240), and the cleaning sequence is terminated (step S242).

In addition, FIGS. 6 to 10 depict an example wherein the blade 70 travels in the longitudinal direction of the recording head 12, but in implementing the present invention, it is also possible to adopt a mode wherein a blade of a length corresponding to the width of the recording head 12 in the longitudinal direction thereof is moved in the direction of the shorter dimension of the print head 12.

Capping Function and Ink Suctioning Function of the Supporting Section

Figure 11:
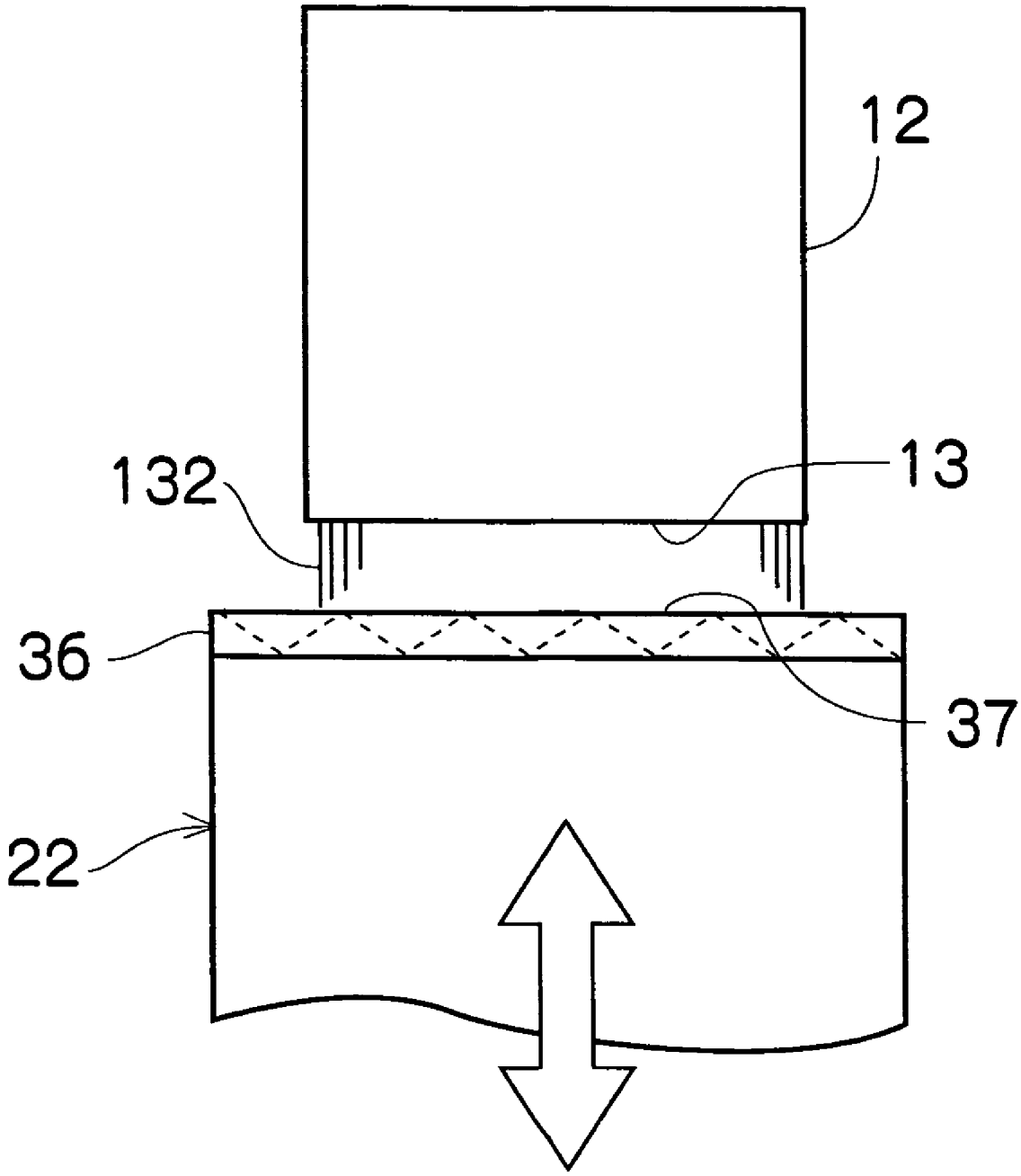
FIG. 11 is an approximate side view showing an example of a device for sealing the nozzle surface of a print head.
Figure 12:
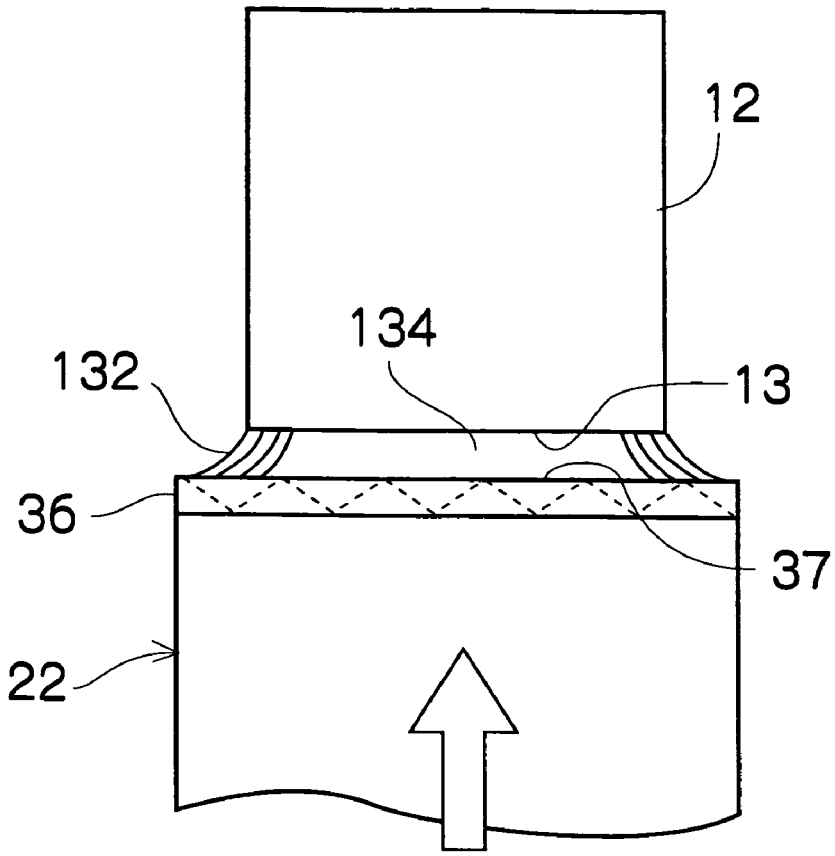
FIG. 12 is an approximate side view showing an example of a device for sealing the nozzle surface of a print head.

FIG. 11 is a side view of the recording head 12 in the direction of the shorter dimension thereof. As shown in FIG. 11, a brush type elastic member 132 is provided about the entire perimeter edge of the nozzle surface 13 of the recording head 12. By raising the supporting section 22 in such a manner that it is approached to the nozzle surface 13, and causing it to halt at the prescribed capping position, the elastic member 132 seals the platen 36 tightly, thereby forming a hermetically sealed space 134, as shown in FIG. 12. In this way, the entire nozzle surface 13 of the print head 12 (or at least the entire range wherein nozzles 51 are formed), is tightly sealed. In the cleaning operation described above, cleaning is performed by means of the above-described first blade 71, which is raisable or lowerable by means of an actuator (not illustrated), or the like, while avoiding the elastic member.

When the power supply is off, or when waiting at standby for printing, it is possible to prevent drying out of the nozzles 51, or an increase in the viscosity of the ink in the vicinity of the nozzles, by covering the nozzle surface 13 by means of the supporting section 22 as shown in FIG. 12. More specifically, the supporting section 22 functions as a protective cap for the print head 12, as well as the elastic member 132.

Furthermore, by driving the suction pumps 39 in the state shown in FIG. 12, the ink can be suctioned from the nozzles 51. More specifically, the supporting section 22 functions as an ink-suctioning device during the nozzle suctioning operation.

In this case, it is possible to control the range of suctioning by selectively controlling the suction pumps (selecting the liquid receiving sections 38A, 38B, or 38C), in accordance with the frequency of use of the nozzles, and the like. Thereby, it is possible to avoid needless ink suction, and hence the amount of ink consumed can be reduced.

Example of Shape of Ink Collecting Device

Figure 13:
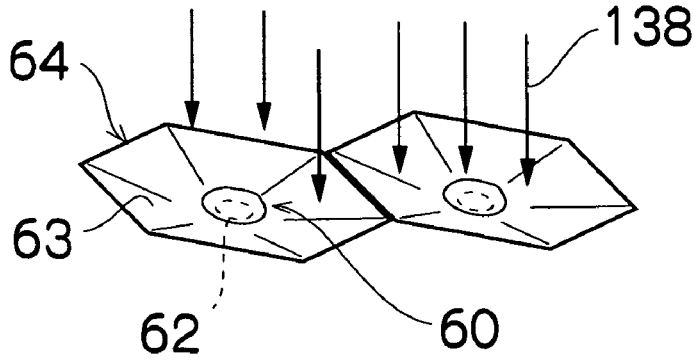
FIG. 13 is a perspective view showing an example of the shape of an ink-collecting device.

FIG. 13 is an enlarged diagram of the ink collecting holes 60 shown in FIG. 6. In the embodiment illustrated in FIG. 6, ink collecting holes 60 whose perimeter ridge lines trace a hexagonal shape, as illustrated in FIG. 13, are described as one example of an ink collecting device. In the case of these ink collecting holes 60, the ink 138 descending in the direction of the arrow from the upper side in FIG. 13 slides down along the inclined surface 63, and collects, and is recovered by suction via the opening 62 in the under side. Furthermore, the recording paper 16 is supported by line contact with the ridge lines 64 of the ink collecting holes 60.

Figure 14:
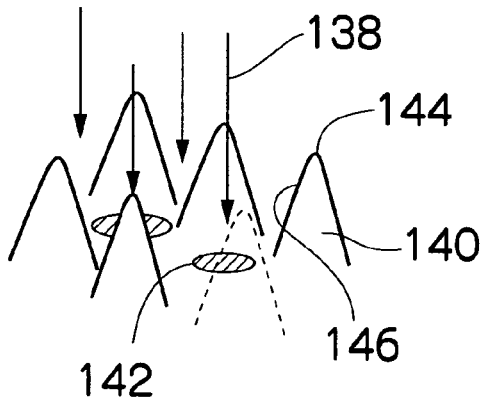
FIG. 14 is a perspective view showing a further example of the shape of an ink collecting device.

In implementing the present invention, the structure of the ink collecting device is not limited to the example in FIG. 13, and it is also possible, for example, to adopt a supporting structure for the recording paper 16 based on point contact as illustrated in FIG. 14.

The ink-collecting device illustrated in FIG. 14 is constituted by projections 140 which support the recording paper 16 by means of point contact, and openings 142 formed at the base sections of the projections 140. These openings 142 are formed into through holes which connect to the rear face of the platen 36.

In FIG. 14, the projections 140 of approximately circular conical shape are depicted, but the shape of the projections is not limited to this, and they may also be a square conical shape.

The height of each projection 140 is made to coincide, in such a manner that the flatness of the recording paper 16 held by point contact on the front-end sections 144 of the plurality of projections 140 is ensured. Furthermore, the side faces of the projections 140 form inclined surfaces 146 which are connected to the openings 142, and ink 138 dropping downwards from above in FIG. 14, in the direction of the arrow, slides down over the inclined surfaces 146 and collects, and it is recovered by suction via the openings 142.

In the case of the composition shown in FIG. 14 also, it is possible to maintain the recording paper 16 in a stable state, and furthermore, it is also possible to prevent soiling of the rear face of the recording paper 16.

Figure 15A:
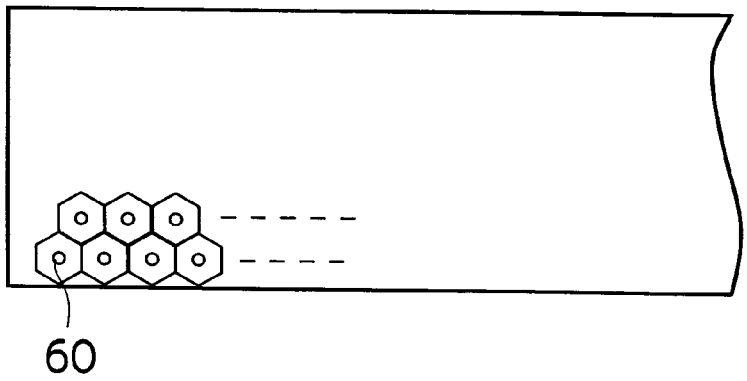
FIGS. 15A and 15B are plan views showing examples of the arrangement of ink collecting holes.
Figure 15B:
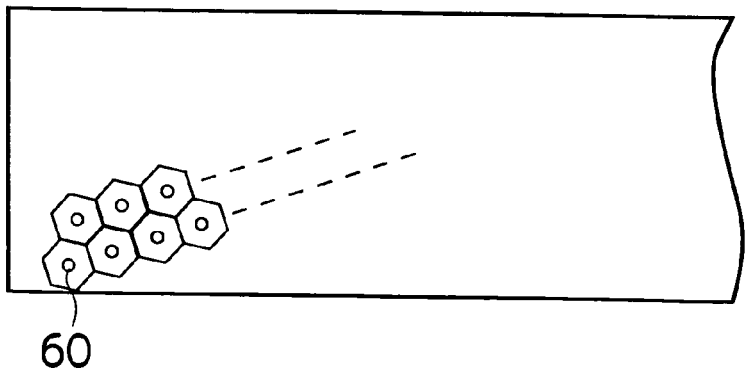

In the platen 36 of the supporting section 22 illustrated in FIG. 6, the ink collecting holes 60 are arranged in a matrix fashion following arrangement lines parallel to the longitudinal direction of the supporting section 22, as shown in FIG. 15A, but the arrangement of the ink collecting holes 60 is not limited to this. For example, as shown in FIG. 15B, it is also possible to adopt a mode where they are arranged following oblique arrangement lines, which have a certain angle with respect to the longitudinal direction of the supporting section 22.

In the present embodiment, an inkjet recording apparatus using a page-wide full line type head having a nozzle row of a length corresponding to the entire width of the recording medium was described, but the scope of application of the present invention is not limited to this, and the present invention may also be applied to an inkjet recording apparatus using a shuttle head which performs image recording while reciprocating a recording head of short dimensions.

Moreover, in the foregoing description, an inkjet recording apparatus was described as one example of an image forming apparatus, but the scope of application of the present invention is not limited to this. For example, the present invention may also be applied to a photographic image forming apparatus wherein developing solution is coated onto a printing paper, by means of a non-contact method. More specifically, the present invention can be applied to a broad range of other image forming apparatuses, which comprise a droplet-discharging step for coating a processing liquid, a functional liquid, or another type of liquid other than ink, onto a medium. The present invention can also be applied to image forming apparatuses based on various types of methods other than an inkjet method, such as an optical photographic print manufacturing apparatus, a thermal transfer recording apparatus using a line head, an LED electrophotographic printer, a silver halide photographic type printer having an LED line exposure head.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a discharging head which has a nozzle surface on which nozzles for discharging liquid droplets are formed;

a medium supporting device which supports a recording medium, the medium supporting device being disposed in a position opposing the nozzle surface of the discharging head and having a medium supporting region on which the recording medium is placed, the medium supporting device including a plurality of liquid collecting devices arranged throughout the medium supporting region in a width direction of the recording medium placed on the medium supporting region, each liquid collecting device having inclined surfaces along which liquid entering from a side of the discharging head is slidable downwards and openings formed at bases of the inclined surfaces and connecting to a rear surface of the medium supporting device; and a suctioning device which suctions the liquid through the openings in the liquid collecting device, wherein the plurality of liquid collecting devices are two-dimensionally arranged close to each other and across the entire medium supporting region, and the inclined surfaces have a downward slope with respect to a horizontal plane in which the recording medium is supported by the medium supporting device and the downward slope is not normal to the horizontal plane.

2. The image forming apparatus as defined in claim 1, wherein the liquid collecting device is constituted by through holes having relatively broad openings on the side of the discharging head, and relatively narrow openings on the side of the suctioning device.

3. The image forming apparatus as defined in claim 2, wherein perimeters of the through holes on the side of the discharging head in the liquid collecting device have a ridge line shape whereby the recording medium is supported by means of line contact.

4. The image forming apparatus as defined in claim 3, wherein the liquid collecting device has the ridge line shape that is not orthogonal to a conveyance direction of the recording medium.

5. The image forming apparatus as defined in claim 1, wherein the liquid collecting device has projections which support the recording medium by means of point contact, and side faces of the projections constitute the inclined surfaces.

6. The image forming apparatus as defined in claim 1, wherein the liquid collecting device has liquid repelling properties.

7. The image forming apparatus as defined in claim 1, further comprising:

a relative movement device which moves at least one of the medium supporting device and the discharging head in a direction of liquid droplet discharge of the discharging head; and a hermetic sealing device which covers a periphery of the nozzle surface and makes contact with the medium supporting device, the hermetic sealing device including an elastic member which hermetically seals the nozzle surface of the discharging head.

8. The image forming apparatus as defined in claim 7, wherein the medium supporting device functions as a capping device which seals the nozzle surface of the discharging head during non-discharging periods, as well as functioning as a head liquid suctioning device which suctions liquid from the nozzles of the discharging head.

9. The image forming apparatus as defined in claim 1, wherein the plurality of liquid collecting devices are arranged throughout an entire surface of the medium supporting region.

10. The image forming apparatus as defined in claim 1, wherein the suctioning device holds the recording medium by suction through the openings in the liquid collecting device.

11. The image forming apparatus as defined in claim 1, wherein an arrangement pattern of the nozzles is identical to an arrangement pattern of the openings of the plurality of liquid collecting devices so that positions of the nozzles respectively correspond to positions of the openings of the plurality of liquid collecting devices.

12. The image forming apparatus as defined in claim 1, wherein the medium supporting device includes a platen disposed in a position opposing the nozzle surface of the discharging head and on which the recording medium is placed, the platen includes the plurality of liquid collecting devices on an upper surface of the platen and arranged throughout the upper surface in a width direction of the recording medium placed on the platen, each liquid collecting device is constituted by through holes having a relatively broad opening on the upper surface of the platen and a relatively narrow opening on an opposing lower surface of the platen, and the through holes have inclined surfaces extending from the upper surface of the platen to the opposing lower surface of the platen and along which liquid entering the relatively broad openings of the through holes from a side of the discharging head is slidable downwards to the relatively narrow openings of the through holes on the opposing lower surface of the platen.

13. The image forming apparatus as defined in claim 1, wherein the medium supporting device includes a platen disposed in a position opposing the nozzle surface of the discharging head and on which the recording medium is placed, the platen includes a plurality of liquid collecting devices on an upper surface of the platen and arranged throughout the upper surface in a width direction of the recording medium placed on the platen, each liquid collecting device is constituted by projections on the upper surface of the platen and an opening on an opposing lower surface of the platen, the projections support the recording medium by means of point contact, and surfaces of each liquid collecting device extending from where each projection makes point contact with the recording medium to the opening in the opposing lower surface of the platen are inclined surfaces along which liquid entering said each liquid collecting device from a side of the discharging head is slidable downwards to the opening on the opposing lower surface of the platen.

14. An image forming apparatus comprising:

a discharging head which has a nozzle surface on which nozzles for discharging liquid droplets are formed;

a medium supporting device which supports a recording medium, the medium supporting device being disposed in a position opposing the nozzle surface of the discharging head, the medium supporting device including a liquid collecting device having inclined surfaces along which liquid entering from a side of the discharging head is slidable downwards, and openings formed at bases of the inclined surfaces and connecting to a rear surface of the medium supporting device;

a suctioning device which suctions the liquid through the openings in the liquid collecting device;

a first cleaning device which makes contact with the nozzle surface of the discharging head;

a second cleaning device which makes contact with a medium supporting surface of the medium supporting device; and a cleaning drive device which moves the first cleaning device and the second cleaning device simultaneously with respect to the nozzle surface and the medium supporting surface in a state where the first cleaning device is in contact with the nozzle surface and the second cleaning device is in contact with the medium supporting device.

15. The image forming apparatus as defined in claim 14, wherein:

the first cleaning device has a first blade which wipes the nozzle surface;

the second cleaning device has a second blade which wipes the medium supporting surface;

the first blade and the second blade are disposed with a prescribed space in a moving direction during the cleaning by means of the cleaning drive device; and the nozzle surface is wiped by the first blade proceeding ahead in the moving direction during the cleaning, droplets are discharged from the nozzles in a nozzle region that has been wiped by the first blade, and a region of the medium supporting surface onto which the discharged droplets have adhered is wiped by the following second blade.

* * * * *